US008839524B2

(12) United States Patent
Owens

(10) Patent No.: US 8,839,524 B2
(45) Date of Patent: Sep. 23, 2014

(54) SCRAPER CHEF KNIFE

(76) Inventor: Dwaine Owens, Salome, AZ (US)

( * ) Notice: Subject to any disclaimer, the term of this patent is extended or adjusted under 35 U.S.C. 154(b) by 0 days.

(21) Appl. No.: 13/250,863

(22) Filed: Sep. 30, 2011

(65) Prior Publication Data

US 2012/0079723 A1 Apr. 5, 2012

Related U.S. Application Data

(60) Provisional application No. 61/404,306, filed on Oct. 1, 2010.

(51) Int. Cl.
*B26B 3/00* (2006.01)
*B26B 9/00* (2006.01)
*B26B 29/02* (2006.01)

(52) U.S. Cl.
CPC . *B26B 3/00* (2013.01); *B26B 29/02* (2013.01); *B26B 9/00* (2013.01)
USPC ..... 30/340; 30/342

(58) Field of Classification Search
CPC ..... B26B 3/00; B26B 3/02
USPC ..... D7/649; 30/340, 342–344, 346, 346.55, 30/353, 357, 169, 291, 295, 298, 312
See application file for complete search history.

(56) References Cited

U.S. PATENT DOCUMENTS

| | | | | | |
|---|---|---|---|---|---|
| 27,349 | A | * | 3/1860 | Carrier | 30/340 |
| 219,996 | A | * | 9/1879 | Strobridge | 30/343 |
| 331,915 | A | * | 12/1885 | Smith | D7/649 |
| 356,452 | A | * | 1/1887 | Cox | 30/340 |
| D27,034 | S | * | 5/1897 | Woods | D7/649 |
| D27,254 | S | * | 6/1897 | Barden et al. | D7/649 |
| D28,186 | S | * | 1/1898 | Barden | 30/353 |
| 628,775 | A | * | 7/1899 | Disston | 30/342 |
| D31,534 | S | * | 9/1899 | McKinzie | D7/649 |
| 683,867 | A | * | 10/1901 | Stryker | 30/342 |
| 891,871 | A | * | 6/1908 | Smith | 30/353 |
| 1,020,055 | A | * | 3/1912 | Renner | 30/342 |
| D43,729 | S | * | 3/1913 | Teller | D7/649 |
| 1,130,281 | A | * | 3/1915 | Hay | 30/340 |
| 1,254,591 | A | * | 1/1918 | Hachmann | 30/342 |
| 1,333,066 | A | * | 3/1920 | Eckert | D7/649 |
| D56,012 | S | * | 8/1920 | Lickert | D7/649 |

(Continued)

FOREIGN PATENT DOCUMENTS

| | | | |
|---|---|---|---|
| DE | 4429063 | A1 * | 2/1996 |
| DE | 102006006065 | * | 8/2007 |
| EP | 0694370 | A1 * | 1/1996 |
| WO | WO 2005039834 | A1 * | 5/2005 |

*Primary Examiner* — Jason Daniel Prone

(57) ABSTRACT

A chef knife is provided. The chef knife includes a blade and a handle. The blade has a length and a spine, wherein the spine of the blade defines a flat surface running the entire length of the blade. The spine of the blade protrudes outward from the handle, such that the spine rises above the top surface of the handle. The blade has a cutting edge, wherein the cutting edge extends below and under the handle. The blade has a depth, which depth increases from the point of the blade to the heel of the blade. Under the condition that the knife is oriented in the cutting position, the handle is angled downward with respect to the plane defined by the flat surface of the spine and the handle is angled upward with respect to the plane defined by a main portion of the cutting edge.

19 Claims, 4 Drawing Sheets

(56) References Cited

U.S. PATENT DOCUMENTS

| | | | | | |
|---|---|---|---|---|---|
| D57,780 | S | * | 5/1921 | Lickert | D7/649 |
| 1,507,526 | A | * | 9/1924 | Straus | 30/144 |
| 1,579,495 | A | * | 4/1926 | Stroud | 30/346 |
| 1,743,029 | A | * | 1/1930 | Ewing | 30/295 |
| 1,754,543 | A | * | 4/1930 | Callum | 30/342 |
| 1,822,828 | A | * | 9/1931 | Stueckman | 30/340 |
| D113,026 | S | * | 1/1939 | Vassos | D7/649 |
| 2,182,303 | A | * | 12/1939 | Platts | 30/342 |
| D120,789 | S | * | 5/1940 | Schoettle | D7/649 |
| D122,057 | S | * | 8/1940 | Johnson | D7/649 |
| 2,309,219 | A | * | 1/1943 | Seely | 30/353 |
| 2,315,898 | A | * | 4/1943 | Krilow | 30/355 |
| D140,469 | S | * | 2/1945 | Baker | 30/340 |
| D147,349 | S | * | 8/1947 | Patti | D7/649 |
| 2,467,327 | A | * | 4/1949 | McKee | 30/344 |
| 2,651,106 | A | * | 9/1953 | Breitzke | 30/342 |
| D183,865 | S | * | 11/1958 | Stephensen | D7/649 |
| D226,410 | S | * | 2/1973 | Kunze | D7/649 |
| D233,232 | S | * | 10/1974 | Koppe | D7/649 |
| D236,422 | S | * | 8/1975 | Gayle | D7/649 |
| 3,900,950 | A | * | 8/1975 | Collins | 30/342 |
| D250,082 | S | * | 10/1978 | Breger | D7/649 |
| D251,177 | S | * | 2/1979 | Sinclair | 30/340 |
| D267,622 | S | * | 1/1983 | Russell | D7/649 |
| D284,537 | S | * | 7/1986 | Pashley et al. | D7/649 |
| D287,692 | S | * | 1/1987 | Brailsford | D8/98 |
| D291,764 | S | * | 9/1987 | Mark | D7/650 |
| D296,179 | S | * | 6/1988 | Hagberg et al. | D7/649 |
| D309,557 | S | * | 7/1990 | Quennessen | D7/649 |
| 5,131,152 | A | * | 7/1992 | Wordtmann et al. | 30/344 |
| 5,155,913 | A | * | 10/1992 | Marttiini | 30/342 |
| 5,241,883 | A | * | 9/1993 | Coppier | 30/346 |
| D341,999 | S | * | 12/1993 | Frahn | D7/693 |
| 5,528,834 | A | * | 6/1996 | Seber et al. | 30/340 |
| 5,669,142 | A | * | 9/1997 | Beckers et al. | 30/340 |
| 5,692,308 | A | * | 12/1997 | Di Libero | 30/353 |
| 6,029,357 | A | * | 2/2000 | Morton | 30/340 |
| D435,199 | S | * | 12/2000 | Cohen et al. | D7/649 |
| D458,511 | S | * | 6/2002 | Rorke | D7/395 |
| D462,581 | S | * | 9/2002 | Parlowski | D7/649 |
| 6,460,255 | B1 | * | 10/2002 | Dassaud | 30/340 |
| 6,460,256 | B2 | * | 10/2002 | Peppel et al. | 30/340 |
| 6,701,624 | B1 | * | 3/2004 | White | 30/340 |
| D553,916 | S | * | 10/2007 | Ono | D7/649 |
| D661,553 | S | * | 6/2012 | Bauer | D7/649 |
| D678,732 | S | * | 3/2013 | Owens | D7/649 |
| D693,173 | S | * | 11/2013 | Chen | D7/649 |
| 8,615,888 | B2 | * | 12/2013 | Catalano et al. | 30/340 |
| 2006/0218802 | A1 | * | 10/2006 | Stevens | 30/340 |
| 2007/0204471 | A1 | * | 9/2007 | Castagna | 30/342 |
| 2012/0079725 | A1 | * | 4/2012 | Hatch et al. | 30/295 |
| 2012/0159793 | A1 | * | 6/2012 | Hatch et al. | 30/340 |
| 2013/0104403 | A1 | * | 5/2013 | Stokes | 30/342 |
| 2013/0280997 | A1 | * | 10/2013 | Ramos | 30/294 |

* cited by examiner

SCRAPER CHEF KNIFE

CROSS REFERENCE TO RELATED APPLICATION[S]

This application claims priority to U.S. Provisional Patent Application to Owens entitled "SCRAPER CHEFS KNIFE," Ser. No. 61/404,306, filed Oct. 1, 2010, the disclosure of which is hereby incorporated entirely herein by reference.

BACKGROUND

1. Technical Field

The following disclosure relates generally to knives, and in particular to chef knives.

2. State of the Art

A knife is a cutting tool with an exposed cutting edge and has been in existence for centuries. Today's knives can generally be broken down into two types: fixed blade knives and folding blade knives. Today's knives are also comprised of at least two parts: the blade and the handle. With a fixed blade knife, the blade and the handle are fixed with respect to one another. With a folding blade knife, the blade is typically structured to retract, fold, or otherwise move with respect to the handle to position the blade, or at least a portion of the blade, within the handle.

One of the more prominent knives in the Western world is the chef's knife, a fixed-blade knife that is also known as a French knife or a cook's knife. The chef's knife is used prominently in the realm of food preparation and is often utilized as a general-utility knife in a chef's kitchen. The standard chef's knife is typically comprised of a blade and a handle. The handle can be attached to the blade after manufacture of the blade itself, or the blade can be integral with the handle, such that the blade and the handle are formed of one piece of material. In the case where the blade is integral with the handle, the portion of the material that forms the handle, or a part of the handle, is referred to as the tang. The tang can extend partially down the length of the handle from the heel of the blade to the butt of the handle or the tang can extend completely down the length of the handle from the heel to the butt. Decorative handles can be formed around the tang by coupling the decorative handles to the tang by way of rivets.

As mentioned above, conventional chef's knives are useful in food preparation, and in particular for mincing, slicing, and chopping vegetables and fruits, among other things, as well as slicing meat and disjointing large cuts of meat. However, the usefulness of the conventional chef's knife is only as good as the knife blade's cutting edge is sharp. Using the cutting edge of the chefs knife for other purposes, such as to move prepared foods from place to place around the cutting surface by scraping the knife's cutting edge across the cutting surface, significantly dulls the cutting edge, which reduces the efficiency of the knife and shortens the knife's life span due to the fact that the knife must more frequently be sharpened. Moreover, the safe use of the knife is diminished in direct correlation with the sharpness of the knife's cutting edge. As the knife's cutting edge is dulled, more and more pressure must be applied by the user to achieve the same cutting result as that of a sharp cutting edge. As more pressure is applied, the knife is more likely to slip and result in cuts and punctures to the user.

There is thus a need in the industry for a chef's knife that addresses the issues presented above.

SUMMARY

The disclosure relates to knives, and in particular to a new and improved chef's knife.

An aspect of the present disclosure includes a chef knife, the chef knife comprising a blade, the blade having a length defined as a distance between a heel of the blade and a point of the blade; a handle; and a spine of the blade, wherein the spine of the blade defines a level surface running the entire length of the blade.

Another aspect of the present disclosure includes the spine of the blade rising above a top surface of the handle, and wherein the handle is angled with respect to the level surface of the spine.

Another aspect of the present disclosure includes a cutting edge of the blade, wherein the cutting edge extends below and under a portion of the handle and wherein a depth of the blade increases from the point of the blade to the heel of the blade.

Another aspect of the present disclosure includes the handle being angled downward with respect to the flat surface of the spine and upward with respect to a plane defined by a main portion of the cutting edge.

Another aspect of the present disclosure includes the chef knife comprising a blade, the blade having a heel and a spine, and a handle, the handle having a top surface wherein the handle protrudes from a middle portion of the heel such that the spine of the blade protrudes outward from the top surface of the handle.

Another aspect of the present disclosure includes the chef knife comprising a blade, the blade having a spine that defines a first plane, a handle, the handle having a top surface that defines a second plane, and a cutting edge, the cutting edge having a main portion that defines a third plane, wherein under the condition that the knife is oriented in a cutting position the second plane is angled downward with respect to the first plane and angled upward with respect to the third plane.

Another aspect of the present disclosure includes the angle between the first and second planes being smaller than the angle between the first and third planes.

Another aspect of the present disclosure includes the angle between the first and second planes being smaller than the angle between the second and third planes.

Another aspect of the present disclosure includes a length of the handle being between 35% and 45%, inclusive, of a total length of the knife.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
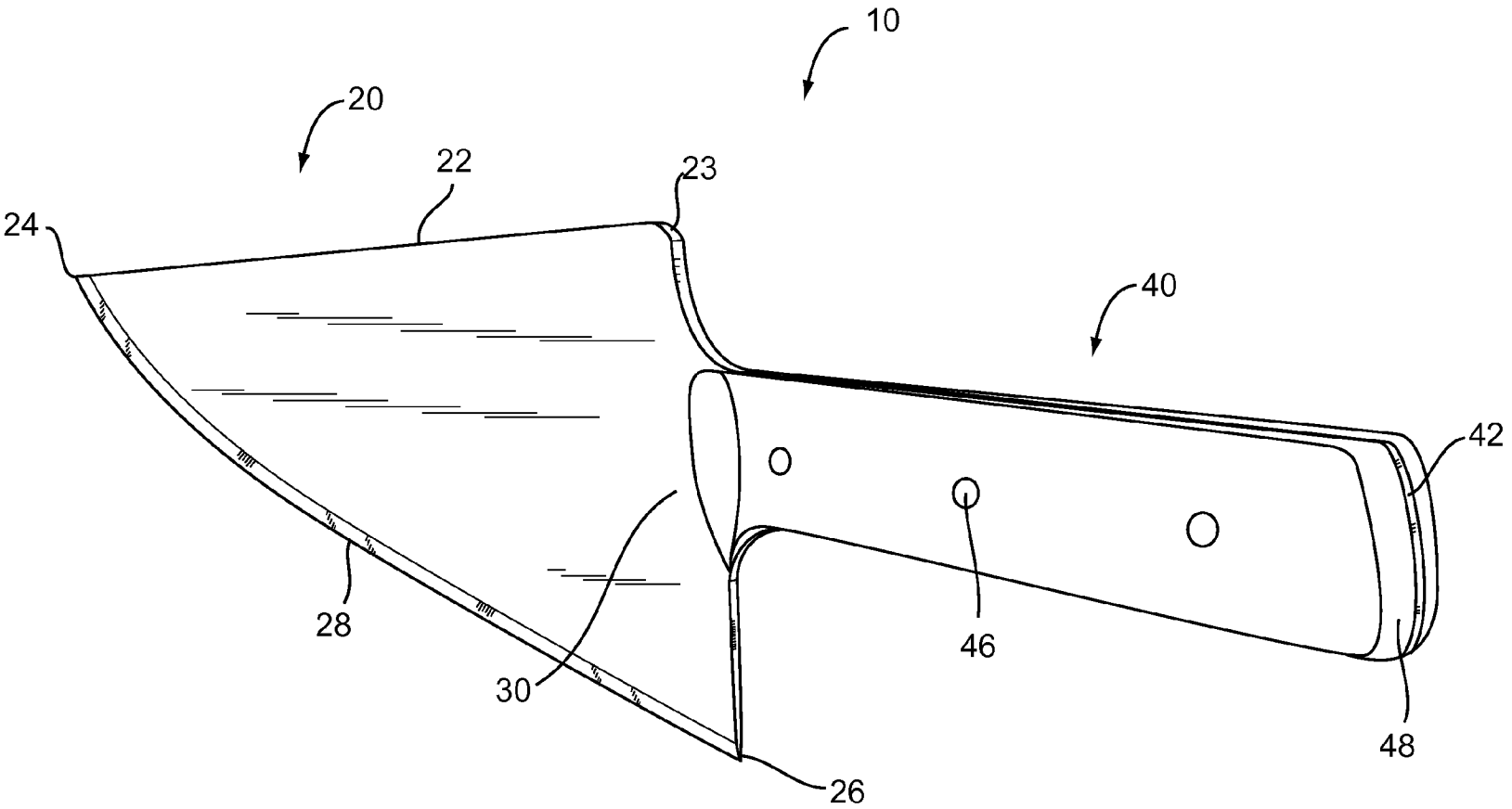
FIG. 1 is a left-side perspective view of a chef knife in accordance with the present disclosure.

Referring to the drawings, FIG. 1 depicts a chef knife 10. Embodiments of the knife 10 may comprise a blade 20 and a handle 40. The blade 20 may further comprise a spine 22, a spine end 23, a point 24, a blade end 26, a cutting edge 28, and a heel 30. The handle may further comprise a tang 42, scales 44 on either side of the tang 42, rivets 46 that couple the scales 44 to the tang 42, and a butt 48. As referred to herein, the length of the knife 10 refers to the direction defined between the point 24 and the butt 48, the width of the knife 10 refers to the direction defined between opposing sides of the blade 20 of the knife 10 (i.e., left-to-right or right-to-left), and the depth of the knife 10 refers to the direction defined between the spine 22 and the cutting edge 28. The depth of the knife 10 also refers to the vertical alignment of the knife 10.

Embodiments of the knife 10 may include the blade 20 being manufactured from materials that provide sufficient strength to allow the blade 20 to function as and perform the purposes of a chef's knife. For example, but not a limitation, the blade 20 may be manufactured of steel, such as carbon steel or stainless steel, a laminate of steel metals, or ceramic materials. The blade 20 may be hot-forged or stamped. Once formed, the blade 20 may be sharpened to provide the cutting edge 28. The blade 20 may have sufficient thickness to allow the cutting edge 28 to accept and hold various edge types, such as, but not limited to: double grind; single grind; flat (V-shape); convex; semi-convex or asymmetrical convex; asymmetrical flat (V-shape); compound or double bevel; hollow ground; chisel or single bevel; chisel with back bevel; and chisel with Urasuki.

Embodiments of the knife 10 may include the handle 40 being manufactured of plastic, rubber, or composite materials. For example, but not by way of limitation, embodiments of the knife 10 may also comprise the handle 40 being manufactured of a composite material consisting of wood that has been treated with plastic resin to give the handle 40 a wood-like appearance. In view of the above, the handle 40 and the blade 20 may be manufactured separately and coupled together at a later time to form the knife 10.

Figure 4:
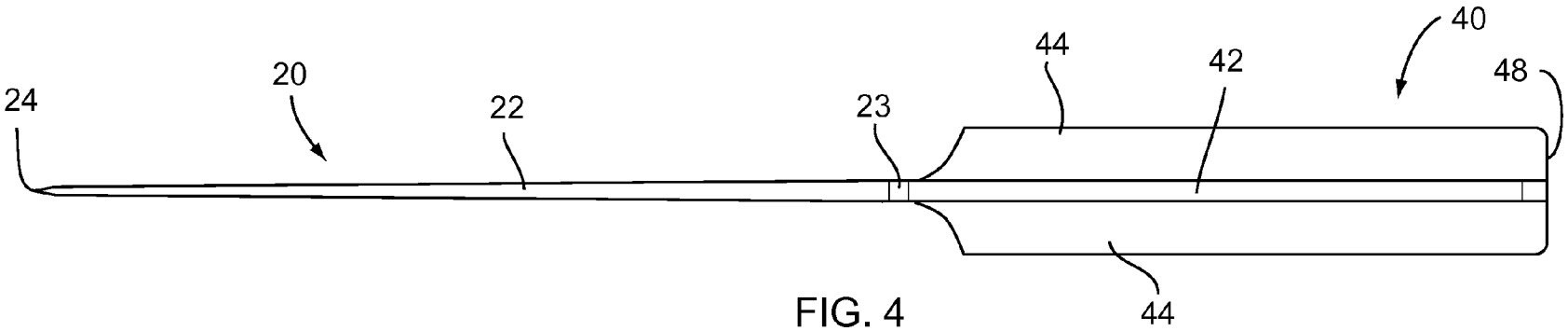
FIG. 4 is a top elevation view of the chef knife in accordance with the present disclosure.
Figure 5:
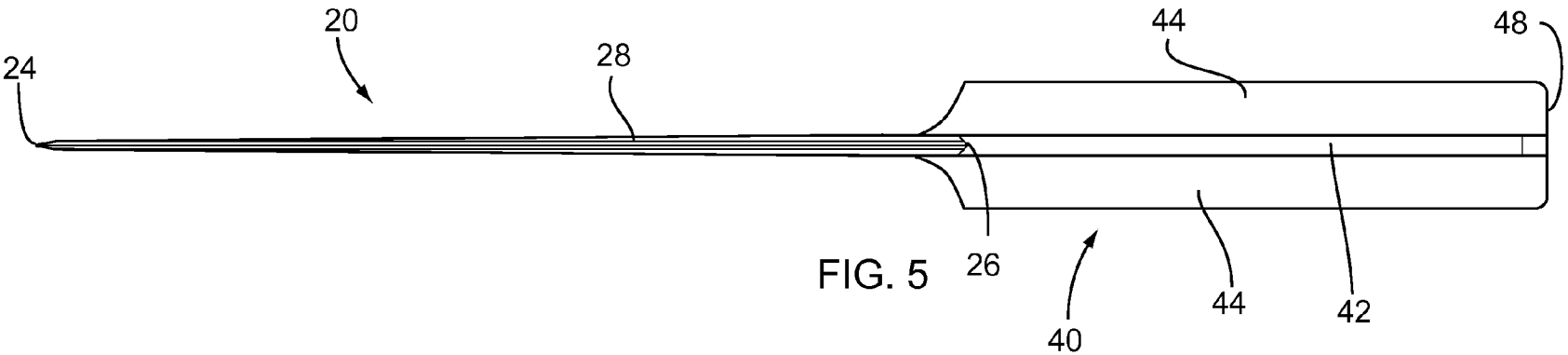
FIG. 5 is a bottom elevation view of the chef knife in accordance with the present disclosure.

Alternatively, the knife 10 may comprise the blade 20 and the tang 42 of the handle 40 being manufactured integrally with one another, such that blade 20 and the tang 42 are manufactured from the same piece of material, such as steel. Thereafter, the rivets 46 may be utilized to attach the scales 44 to the tang 42 to form the handle 40 that is comfortable in the user's hand. The tang 42 may extend partially down the length of the scales 44, such that the tang 42 does not reach the butt 48 of the handle 40. The tang 42 may also extend completely down the length of the scales 44, such that the tang 42 reaches the butt 48 of the handle 40, as shown in FIGS. 1, 4 and 5.

Figure 2:
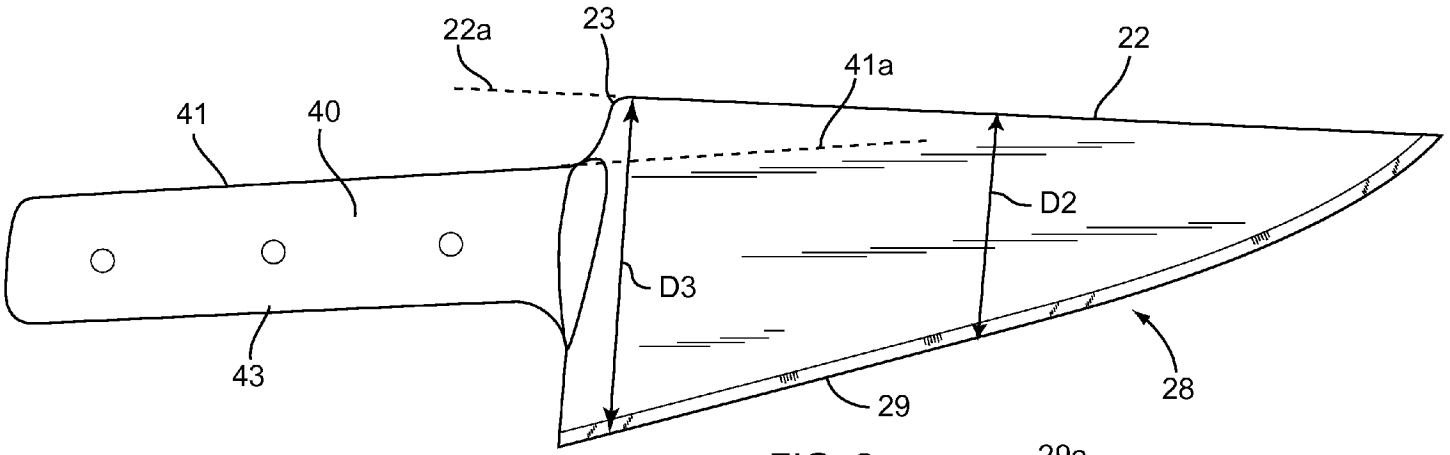
FIG. 2 is a right-side elevation view of the chef knife in accordance with the present disclosure.
Figure 3:
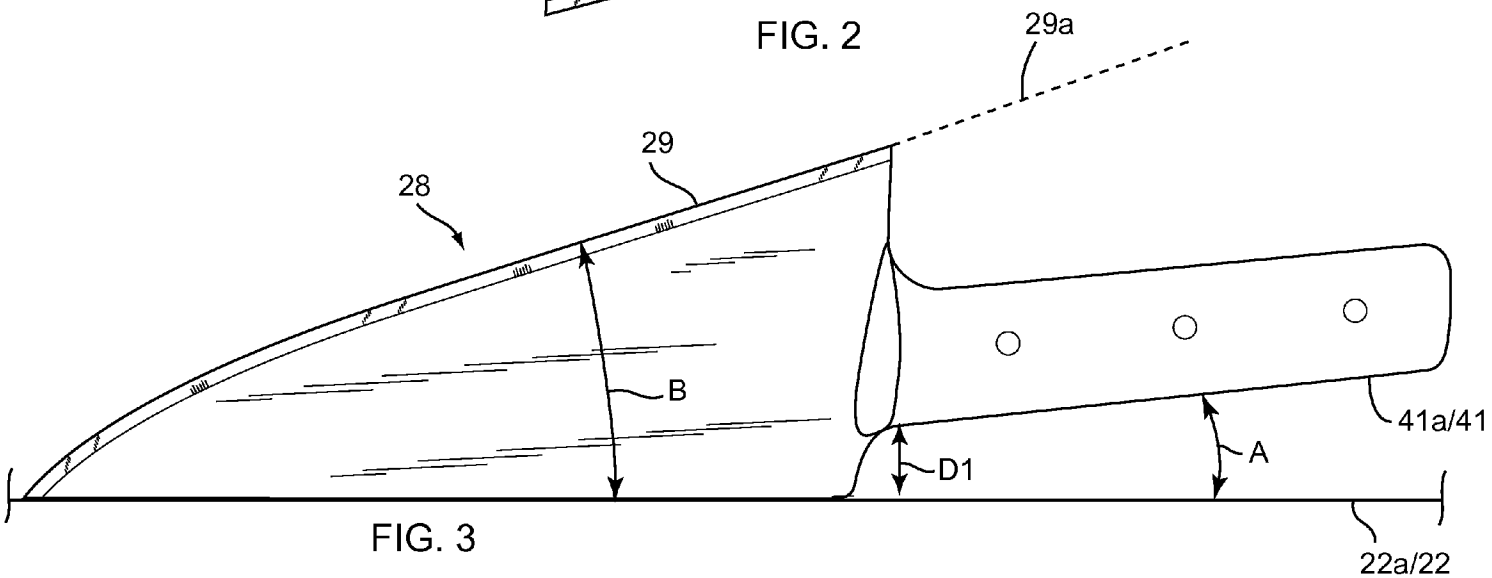
FIG. 3 is a right-side elevation view of the chef knife upside-down in accordance with the present disclosure.

As depicted in FIGS. 2 and 3, embodiments of the knife 10 may include the spine 22 of the blade 20 being substantially planar from the spine end 23 to the point 24. A spine 22 that is straight, flat, uniform, or otherwise substantially planar along its entire length, allows the user of the knife 10 to flip the knife 10 upside down, or in other words rotate the knife 10 180 degrees from its cutting position with a cutting edge 28 facing a cutting surface 8 to its scraping position with the spine 22 facing the cutting surface 8, and use the spine 22 as a scraping surface along the spine's 22 entire surface, or in other words, along the entire length of the blade 20. It follows that the cutting surface 8 may provide a dual function depending on the orientation of the knife 10. The cutting surface 8 may be a cutting surface when the knife 10 is used as a cutting tool with its cutting edge 28 facing the cutting surface 8. The cutting surface 8 may be a scraping surface when the knife 10 is used as a scraping tool with its spine 22 facing the cutting surface 8.

A planar, or otherwise flat, spine 22 along the entire length of the blade 20 provides advantages and benefits over conventional chef's knives that do not have such a spine. For example, the planar spine 22 of the present disclosure provides a more effective scraping surface for the user to use to avoid dulling the cutting edge 28 of the knife 10. Specifically, by providing a flat scraping spine 22 that runs the entire length of the blade 20, when the user flips the knife 10 of the present disclosure upside down, or rotates the knife 10 180 degrees, as described above, the user can efficiently scrape food and other items along, or off, the cutting surface 8 instead of using the cutting edge 28 to do so, which action would quickly dull the cutting edge 28.

Embodiments of the knife 10 may further include the spine 22 projecting vertically above the handle 40. Embodiments of the knife may further include the handle 40 having a bottom surface 43. Embodiments of the knife 10 may further include at least a portion of the spine 22, and in particular the portion of the spine 22 near the heel 30, being raised above a horizontal plane 41*a* defined by the top surface 41 of the handle 40. A raised spine 22 provides advantages and benefits over conventional chef's knives that do not have such a spine. For example, as depicted in FIG. 3, when the user flips the knife 10 of the present disclosure upside down, or rotates the knife 10 180 degrees from its cutting edge 28 facing the cutting surface 8, as shown in FIG. 2, to its spine 22 facing the cutting surface 8, as shown in FIG. 3, for the purpose of using the spine 22 as a scraper on the cutting surface 8, the raised spine 22 provides a distance D1 between the handle 40 and the cutting surface 8 that conventional chef's knives do not provide. This distance allows a user to grip the handle 40 in his/her palm with his/her fingers wrapped around the handle 40 without the user's fingers contacting the cutting surface 8 or coming into contact with the scraped items.

Embodiments of the knife 10 may further include the spine 22 being flat, straight, uniform, or otherwise planar, along the entire length of the blade 20, as described above, in conjunction with the spine 22 being raised above the handle 40, as described above, and shown in FIG. 2.

As further depicted in FIGS. 2 and 3, embodiments of the knife 10 may further include the handle 40 of the knife 10 extending from the heel 30 of the blade 20 at a point between the spine end 23 and the blade end 26.

Embodiments of the knife 10 may further include the blade 20 having a depth D2, defined by a distance between the spine 22 and the cutting edge 28 along a line orthogonal to the plane of the spine 22 at any point along the spine 22. Embodiments of the knife 10 may include the blade 20 having a depth D2 that increases from the point 24 to the spine end 23, such that a large distance D3 is defined between the spine end 23 and the corresponding point on the cutting edge 28. The blade 20 may also have a depth-to-length ratio defined as the large distance D3 divided by the length of the blade 20 from the point 24 to the spine end 23. Embodiments of the knife 20 may have a depth to length ratio from between 25% to 55%. Such a ratio produces a blade 20 with sufficient length to provide effective cutting capability and with sufficient depth to keep a user's fingers out of the processed food. Embodiments of the knife 10 may have a depth to length ratio from between 32% to 50%. Such a ratio produces more efficient cutting capability while providing the advantages described above with respect to the previous range. Embodiments of the knife 10 may have a depth to length ratio from between 38% to 45%. Such a ratio produces even more efficient cutting capability than that described above with respect to the previous ranges while still providing the advantages described above with respect to the previous ranges. The depth of the blade 20 allows the user's hand that is placed on the knife 10 and operates the knife 10 to remain free and clear of the objects being chopped, sliced, or otherwise processed by the knife 10.

Embodiments of the knife 10 may further include the cutting edge 28 of the blade 20 extending horizontally below the handle 40, such that a portion of the cutting edge 28 is positioned below a portion of the handle 40. Such a configuration provides the knife 10 with a longer cutting edge 28 and serves to help keep the user's hand that is placed on the knife 10 and operates the knife 10 to remain free and clear of the objects being chopped, sliced, or otherwise processed by the knife 10.

Embodiments of the knife 10 may further include the handle 40 being angled with respect to the horizontal plane created by the planar spine 22, as shown in FIGS. 2 and 3. In the cutting position, as shown in FIG. 2, the horizontal plane 41*a* defined by the upper surface 41 of the handle 40 is angled with respect to the horizontal plane 22*a* of the planar spine 22. Indeed, the handle 40 is angled downward with respect to the plane 22*a*. For ease in explanation, as seen in FIG. 3, when the knife 10 is flipped upside down, or rotated 180 degrees from its cutting position to its scraping position, as described above, to engage the planar spine 22 against the cutting surface 8, the cutting surface 8 and the horizontal plane 22*a* of the planar spine 22 become substantially one-in-the same, or co-planar. Accordingly, an angle A between the handle 40 and the plane 22*a* of the spine 22 can be measured as the angle between the cutting surface 8 and the plane 41*a* of the upper surface 41 of the handle 40. The angle A provides several advantages over conventional chef's knives without such an angle. The angle A raises the handle 40 of the knife 10 above the cutting surface 8 even further than does the raised spine 22 alone. Thus, by having a raised spine 22 and an angled handle 40 with respect to the plane 22*a* of the raised spine 22, the handle 40 is raised even further away from the cutting surface 8 so as to better allow a user to grip the handle 40 in his/her palm with his/her fingers wrapped around the handle 40 without the user's fingers contacting the cutting surface 8 or coming into contact with the scraped items on the cutting surface 8.

In embodiments of the knife 10, to provide adequate cutting leverage and/or pressure from the handle 40 to the cutting edge 28 as it cuts against the cutting surface 8, a plane 29*a* defined by the main portion 29 of the cutting edge 28 may be angled with respect to the plane 22*a* of the spine 22. In the cutting position, as shown in FIG. 2, the handle 40 is angled upward with respect to the plane 29*a*. For ease of explanation, as shown in FIG. 3, an angle B may define the angle between the plane 29*a* of the main portion 29 of the cutting edge 28 and the plane 22*a* of the spine 22. By comparison, the angle A is less than the angle B, such that the plane 41*a* is angled with respect to the plane 22*a* somewhere in between the angle of the plane 29*a* and angle of the plane 22*a*. In other words, when angle A is less than angle B and the knife 10 is oriented vertically in the cutting position, as shown in FIG. 2, and is ready to be used by the user, the handle 40 is angled downward with respect to the plane 22*a* of the spine 22 and yet angled upward with respect to the plane 29*a* of the main portion 29 of the cutting edge 28. This particular angled configuration of the handle 40 not only provides advantageous leverage to the cutting edge 28 on the cutting surface 8 from pressure applied to the handle 40, but also permits the handle 40 to be angled upward from the cutting surface 8 when the knife 40 is turned upside down.

Further with regard to the angle of the handle 40 and the cutting edge 28, as the measure of angle A approaches the measure of angle B, the advantageous leverage effects from pressure applied to the handle 40 are reduced. This is due to the fact that as the measure of angle A becomes closer to the measure of angle B, the handle 40 is no longer angled upward with respect to the plane 29*a* of the cutting edge 28. Moreover, on the other hand, as the measure of angle A is reduced to zero, the advantageous effects of the handle 40 being raised further above the cutting surface 8 when the knife 10 is upside down and being used as a scraper are likewise reduced. This is due to the fact that as the measure of angle A becomes closer to the angle of the plane 22*a*, the handle 40 is no longer angled upward away from the cutting surface when the knife 10 is upside down. Thus, the angle A between the handle 40 and the plane 22*a* of the spine 22 can be between 2 and 10 degrees while the angle B between the main portion 29 of the cutting edge 28 and the spine 22 can be between 11 and 23 degrees. Also, embodiments of the knife 10 may further include the angle A being between 3 and 6 degrees and the angle B being between 14 and 20 degrees, which provides good pressure and leverage to the cutting edge 28 against the cutting surface 8 through the handle 40. Also, embodiments of the knife 10 may further include the angle A being about 5 degrees and the angle B being about 17 degrees, which provides even better pressure and leverage to the cutting edge 28 against the cutting surface 8 through the handle 40.

Embodiments of the knife 10 may further include the handle 40 having a length as a ratio, or percentage, of the total length of the knife 10. By having the ratio of the length of the handle 40 being within a particular percentage of the overall length of the knife 10, the knife 10 can be balanced as needed by the weight of the handle 40, the weight of the handle 40 oftentimes being a product of the length of the handle 40. Moreover, a relative length of the handle 40 with respect to the length of the knife 10 also provides better grip and maneuvering of the knife 10 during cutting of foods and products against the cutting surface 8. For example, the length of the handle 40 may be between 35% and 45% of the total length of the knife 10.

Figure 6:
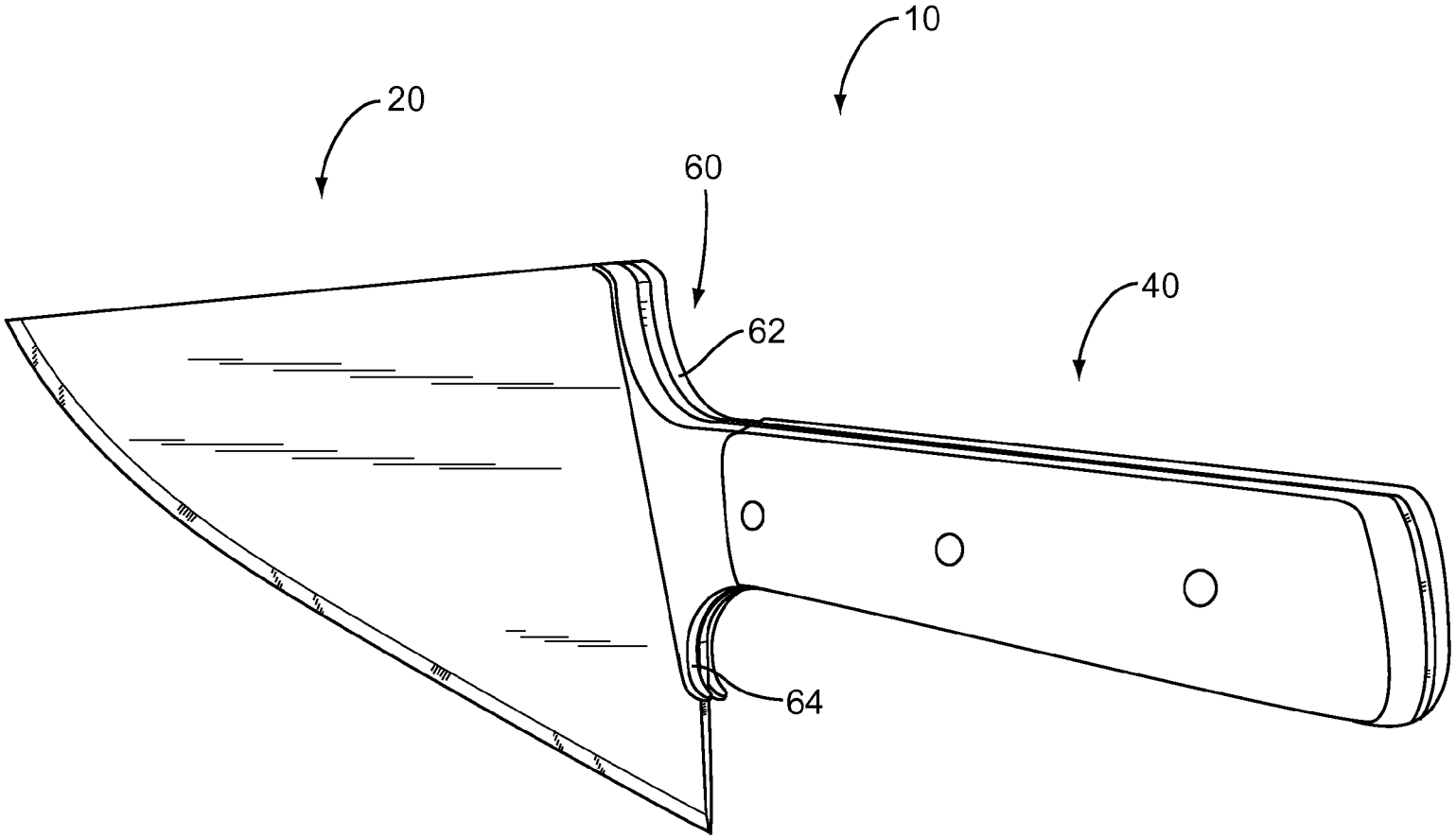
FIG. 6 is a left-side perspective view of the chef knife in accordance with the present disclosure.

As depicted in FIG. 6, embodiments of the knife 10 may further include a bolster/guard 60. The bolster/guard 60 may be formed integrally with the knife 10 or may, alternatively, be installed after the knife 10 has been manufactured. The bolster/guard 60 may be configured to protect the user's palm, hand, or fingers, as the case may be, from pressure that might otherwise apply to the user's hand from use of the knife 10. The bolster/guard 60 essentially is configured to dissipate pressure between the user and the knife 10, such that any one point between the user and the knife 10 during use of the knife 10 does not become overly agitated or distressed. The bolster/guard 60 may be formed integrally with the knife 10 at a position proximate the heel 30 of the blade 20 and the handle 40 near the blade 20, such that the user may utilize the bolster/guard 60 to grip and better secure the knife 10 within the user's hand while cutting, or otherwise using, the knife. The bolster/guard 60 may also be configured to attach to the handle 40, the blade 20, or a combination of the handle 40 and the blade 20, so long as the bolster/guard 60 is securely coupled to the knife 10. For example, as depicted in FIG. 6, the bolster/guard 60 may comprise an upper portion 62 and a bottom portion 64. The upper portion 62 may be configured to form around each side of the spine end 23 and have a width larger than the width of the spine 22 so as to dissipate the pressure between the spine end 23 and the user's palm or fingers. Similarly, the lower portion 64 may be configured to form around each side of the end of the blade 20 between the blade end 26 and the handle 40 and have a width larger than the width of the blade 20 so as to dissipate the pressure between the blade 20 and the user's palm or fingers, as the case may be.

Other configurations of the bolster/guard 60 are contemplated by the present disclosure so long as they provide similar function to the bolster/guard 60 described above. For example, the bolster/guard 60 may cover completely the spine end 23, such that the spine end 23 is not visible under the bolster/guard 60. Moreover, the width of the bolster/guard 60 may be larger than that shown in the Figures, so as to dissipate the pressure between the bolster/guard 60 and the user over a larger area. The bolster/guard 60 may further be shaped in a configuration to best receive a user's grip of the knife 10.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A chef knife, the chef knife comprising:

a blade, the blade further comprising:

a point;

a heel;

a cutting edge running from the point to the heel;

a spine opposing the cutting edge;

a handle fixedly coupled to the blade at the heel, wherein the spine is defined between the point and a spine end, the spine end being spaced from the handle in a direction opposing the cutting edge, wherein the spine defines a flat surface from the point to the spine end, wherein a depth of the blade continuously increases from the point to the heel, wherein the handle protrudes outwardly from a middle portion of the heel in a direction opposing the point, and wherein, under a condition the knife is viewed in profile with the spine above the cutting edge, a portion of the cutting edge at the heel extends underneath a portion of the handle in the direction opposing the point; and a guard member configured proximal the heel, the guard member having a first portion configured on one side of the heel and a second portion spaced from the first portion on an opposed side of the heel where the heel is exposed through the space defined between the first and second portions.

2. The chef knife of claim 1, wherein the blade further comprises a tang, wherein the handle is comprised of one or more scales fixedly coupled to the tang, the handle running from a butt of the blade to the heel.

3. The chef knife of claim 1, wherein the handle is angled away from the flat surface of the spine.

4. The chef knife of claim 1, wherein the handle is angled away from a plane defined by a main portion of the cutting edge.

5. The chef knife of claim 1, wherein the blade is made of steel.

6. A chef knife, the chef knife comprising:

a blade, the blade further comprising:

a point;

a heel;

a cutting edge defined between the point and a terminal end at the heel; and a spine defined between the point and a spine end, the spine opposing the cutting edge;

a handle fixedly coupled to the blade at the heel, the handle being coupled to the blade at the heel between the spine end and the terminal end such that a first heel edge is positioned between the handle and the spine end and a second heel edge is positioned between the handle and the terminal end; and a guard member configured proximal the heel, the guard member having a first portion configured on one side of the second heel edge and a second portion spaced from the first portion on an opposed side of the second heel edge where the second heel edge is exposed through the space defined between the first and second portions.

7. The chef knife of claim 6, wherein a depth of the blade continuously increases from the point to the terminal end at the heel.

8. The chef knife of claim 6, wherein the spine defines a flat surface from the point to the spine end and the handle is angled away from the flat surface of the spine.

9. The chef knife of claim 6, wherein, under a condition the knife is viewed in profile with the spine above the cutting edge, a portion of the cutting edge at the heel extends underneath a portion of the handle in a direction opposing the point.

10. The chef knife of claim 9, wherein the handle is angled away from a plane defined by a main portion of the cutting edge.

11. The chef knife of claim 6, wherein the second portion of the guard member extends partway to the terminal end.

12. The chef knife of claim 6, wherein the blade further comprises a tang, the tang and the blade being formed of an integral piece of steel.

13. A chef knife, the chef knife comprising:

a blade having a point end, a heel, and a butt end, the butt end opposing the point end and the heel positioned between the butt end and the point end;

a guard member configured proximal the heel, the guard member having a first portion configured on one side of the heel and a second portion spaced from the first portion on an opposed side of the heel where the heel is exposed through the space defined between the first and second portions;

a spine of the blade, the spine being a flat surface defined between the point end and a spine end, the flat surface of the spine defining a first plane that extends infinitely in a direction of the butt end;

a handle, the handle having a flat top surface that defines a second plane that extends infinitely in the direction of the butt end the first and second planes defining a first angle therebetween; and a cutting edge of the blade, the cutting edge having a flat main portion defined between a terminal portion of the cutting edge that opposes the point end and a midpoint of the cutting edge, the flat main portion defining a third plane that extends in the direction of the butt end, wherein as the knife is viewed in profile the second plane is positioned between the first and third planes and the first, second, and third planes are spaced from one another in the direction of the butt end, wherein the spine end is spaced from the handle in a direction opposing the cutting edge, wherein the first and second planes separate from one another infinitely in the direction of the butt end and the second and third planes separate from one another infinitely in the direction of the butt end, and wherein a depth of the blade continuously increases from the point end to the heel.

14. The chef knife of claim 13, wherein the handle extends from a middle portion of the heel of the blade, such that the spine end of the blade is spaced from the handle of the blade.

15. The chef knife of claim 13, wherein, under a condition the knife is viewed in profile with the spine above the cutting edge, a portion of the cutting edge at the heel extends underneath a portion of the handle in a direction opposing the point.

16. The chef knife of claim 13, wherein a measure of an angle defined between the first and second planes extending infinitely in the direction of the butt end is smaller than a measure of an angle defined between the first and third planes extending infinitely in the direction of the butt end.

17. The chef knife of claim 13, wherein a measure of an angle defined between the first and second planes extending infinitely in the direction of the butt end is smaller than a measure of an angle defined between the second and third planes extending infinitely in the direction of the butt end.

18. The chef knife of claim 11, wherein a terminal end of the second portion of the guard member flares outward from the second heel edge.

19. The chef knife of claim 11, wherein the second portion of the guard member has a profile shape at the terminal end that corresponds to a profile shape of the terminal end.

* * * * *